United States Patent [19]

Detz et al.

[11] 4,206,288

[45] Jun. 3, 1980

[54] MICROBIAL DESULFURIZATION OF COAL

[75] Inventors: Clifford M. Detz, White Plains; George Barvinchak, Chappagua, both of N.Y.

[73] Assignee: Union Carbide Corporation, New York, N.Y.

[21] Appl. No.: 903,146

[22] Filed: May 5, 1978

[51] Int. Cl.[2] ..... C07G 17/00

[52] U.S. Cl. ..... 435/267; 435/282; 209/9; 210/7

[58] Field of Search ..... 209/4, 9; 44/1 R, 1 RS; 195/2, 3 R, 3 H; 75/101, 161; 210/7, 2, 14, 16; 435/267, 282

[56] References Cited

U.S. PATENT DOCUMENTS

| | | | |
|---|---|---|---|
| 2,829,964 | 4/1958 | Zimmerley | 75/104 |
| 3,007,235 | 9/1961 | Duncan | 75/101 |
| 3,218,252 | 11/1965 | Glover | 195/2 X |
| 3,305,353 | 2/1967 | Duncan | 195/2 X |
| 4,080,287 | 3/1978 | Comby | 210/7 |

FOREIGN PATENT DOCUMENTS

| | | | |
|---|---|---|---|
| 684552 | 4/1964 | Canada | 75/101 |
| 744701 | 10/1966 | Canada | 75/101 |
| 2557008 | 7/1977 | Fed. Rep. of Germany | 195/2 |
| 2737609 | 3/1978 | Fed. Rep. of Germany | 210/7 |
| 47-14602 | 5/1972 | apan | 75/101 R |

OTHER PUBLICATIONS

Silverman et al., Studies on the Chem. Autotophic Iron Bacterium *Fenobacillus ferrooxidans*, Syracuse Univ., 326-331, Dent of Bact. & Botony 2/1959.

Silverman et al., *Fenobacillus ferrooxidans*, Syracuse Univ., 10/1958, p. 642-647.

Silverman, Rmoval of Pyritic Sulfur from Coal by Bact. Action Fuel, vol. 42(2), Mar. 1963, 113-124.

Acid Mine Drainage Formation & Abutment, Ohio State Research Foundation for EPA, Program No. FWPCA Grant No. 14010 FRR, Apr. 1971, pp. 55, 67.

Dugan et al., Microbiol. Desulf. of Coal, Ohio State Univ., 1978, pp. 1-28.

*Primary Examiner*—Robert Halper

*Attorney, Agent, or Firm*—Saul R. Bresch

[57] ABSTRACT

A process for the removal of pyrite from coal wherein an aqueous slurry containing finely-divided coal particles is subjected to the action of iron and sulfur oxidizing microorganisms selected from the *Thiobacillus ferrooxidans* group in a concentration range of between about $3\times10^{10}$ and $1\times10^{12}$ cells per gram of pyrite present in the coal slurry.

48 Claims, 12 Drawing Figures

FIRST ORDER RATE PLOT FOR THE MICROBIAL LEACHING OF PYRITE FROM ILL NO. 2 COAL

RATE OF MICROBIAL PYRITIC SULFUR LEACHING AS A FUNCTION OF THE CELLS/GRAM OF PYRITE RATIO

RATE CONSTANT OF IRON OXIDATION AS A FUNCTION OF SLURRY CONCENTRATION USED TO OBTAIN REACTION WATER (ILL NO. 2 COAL)

MICROBIAL DESULFURIZATION OF COAL

BACKGROUND

The present invention relates to a process for the removal of pyritic sulfur from coal.

Most coals which are available for use in this country contain a high concentration of sulfur which must be reduced to a minimum level in order that these coals may be combusted without the emission of objectionable quantities of sulfur oxides into the atmosphere. The sulfur is generally present in coal in the form of sulfate sulfur, organic sulfur and pyritic sulfur. The organic sulfur is chemically bonded within the organic molecular framework of the coal, while the pyritic sulfur consists of sulfur in the form of iron pyrite, which is disseminated as a separate mineral phase throughout the body of the coal. In general, sulfate sulfur constitutes a minor fraction of the sulfur content in coals, i.e., less than about 0.2 weight % of the coal. The organic sulfur and pyritic sulfur constitutes the major fraction of sulfur which is present in coal and together they constitute up to about 5–8 weight % of the coal. The pyritic sulfur constitutes between 40 and 60 percent of the total sulfur content in the coal. Therefore, the removal of the pyritic sulfur alone can significantly reduce the sulfur content and, therefore, the sulfur emissions which occur upon combustion of coal.

Because the organic sulfur is an integral part of the chemical structure of the coal, it is impossible to remove this sulfur without severely disrupting the chemical bonding which occurs within the structure of the coal. As a result, processes which remove substantial fractions of the organic sulfur are characterized by extreme process conditions, e.g., pressure, temperature, etc. They are, therefore, expensive and require the input of large quantities of energy. Moreover, the product which results from such processes has distinctly different properties from the starting coal as relate to structure, chemical composition, grindability and combustibility.

The pyritic sulfur, on the other hand, exists as a distinct phase within the body of the coal. It is, therefore, possible to liberate the pyrite from the coal physically, and by means of selective physical or chemical techniques to remove the liberated pyrite from the coal, without altering in any significant way the properties of the coal.

Heretofore, a variety of physical and mechanical methods have been employed to remove pyrite from coal. These include heavy media separation, jig tables, selective agglomeration and floatation. In general, however, these techniques result in substantial removal of pyritic sulfur coupled with a significant recovery of cleaned coal only when the size of the pyrite particles disseminated throughout the coal is greater than about two millimeters. Because the size of pyrite particles within the vast majority of coals is much smaller than that which can be effectively removed by the abovementioned techniques, these techniques have found only limited application. In order to remove this finely-divided pyrite from the coal after it has been liberated by mechanical means, it is generally necessary to employ chemical methods.

It is generally known that pyritic sulfur can be removed from coal by chemical oxidization to a species which is soluble in water. Such processes are described, for example, in U.S. Pat. No. 3,768,988 to Meyers and U.S. Pat. No. 3,960,513 to Agarwal. Since these processes require the use of both elevated temperatures and pressures, however, they have not resulted in cost-effective methods for removing pyrite from coal.

Microbiological processes for leaching pyrite as well as other mineral sulfides from inorganic ore bodies under conditions near ambient are also well known in the art. For instance, U.S. Pat. No. 2,829,964 to Zimmerly discloses a cyclic leaching process for extracting metallic constituents from inorganic metallurgical materials, using a leaching medium which is cyclically regenerated by the action of iron oxidizing bacteria. Such processes have proven successful in leaching chalcopyrite ($CuFeS_2$) to produce a product containing substantially pure copper.

Attempts have been made in the past to utilize similar microbiological processes for leaching pyrite from coal. These attempts have not proven altogether successful for reasons that have not heretofore been completely understood. Probably the earliest work on microbiological leaching of pyrite from coal was conducted by Silverman et al. and is reported in an article by these workers, appearing in FUEL, Vol. 42, published by I.P.C. Science & Technology Press, Surry, England, 1963. In this earlier work, experiments were conducted using small volumes of a slurry containing 2.5 weight % coal in flasks. The pH of the slurry was adjusted to an initial value of between about 2.5 and 3.5. The slurry was then inoculated with approximately $5\times10^9$ cell/ml. of a resting cell suspension of an iron and sulfur oxidizing microorganism i.e. *Thiobacillus ferrooxidans.* This cell concentration was equivalent to a ratio of $2\times10^{12}-2\times10^{13}$ cells per gram of pyrite depending on the particular coal. The flasks were shaken at room temperature to agitate the slurry. It was reported in this article that the leaching action effectively stopped after a period of approximately four days. During this period, it was determined that between 45 and 55 percent of the pyrite had been removed. Other results reported in the same article are highly variable and indicate that depending on the particular coal being treated, approximately between zero and 76 percent of the pyritic sulfur was removed. Although the early work of Silverman, et al. did attempt to follow the teachings of the prior art relating to microbiological leaching of inorganic sulfide minerals, the results of this work surprisingly indicate that the prior art processes do not successfully lend themselves to the removal of pyrite from coal. The exact reasons for the apparent ineffectiveness of prior art processes for mineral leaching when applied to coal are not completely understood. However, it is believed that this result is attributable in part to the inherent differences between the organic coal and the inorganic mineral rock material exposed to the leaching medium. For example, it is postulated that relatively rapid and complete leaching of pyrite from coal requires an actively growing population of microorganisms and that the conditions for maintaining such a population in the presence of organic coal material are different than those which have been employed in prior art process for leaching inorganic mineral material.

BRIEF DESCRIPTION OF THE INVENTION

The present invention is directed to a process for removing pyrite from coal wherein a coal slurry containing microorganisms which are capable of oxidizing inorganic chemical species containing iron or sulfur or both, such as pyrite, is prepared and maintained under conditions which effectively promote the dynamic growth of the organisms in the presence of coal. For the sake of simplicity, such microorganisms shall hereinafter be referred to as "iron and sulfur oxidizing organisms". Specifically, it has been unexpectedly found that the initial cell concentration of the iron and sulfur oxidizing organisms should be at a level which is significantly lower than that used in the process of Silverman et al. Accordingly, the initial concentration of the iron and sulfur oxidizing organisms, and especially the organisms of *Thiobacillus ferrooxidans* group, should be kept within the range of between about $3\times10^{10}$ and $1\times10^{12}$ cells per gram of pyrite present in the coal slurry. It has also been found that for optimum growth of the bacteria and, therefore, optimum continued leaching of pyrite, the pH of the coal slurry should be maintained at a specific value between about 1.5 and 6, and the temperature of the slurry should be kept in the range of between about 10° and 35° C. In addition, it has been found that the coal slurry should be subjected to oxygen or an oxygen-containing atmosphere e.g. air or oxygen enriched air, and that the slurry should be agitated by known methods during the period that the coal is subjected to the action of the organism. Further, in the preferred practice of the invention, nutrients may be added to the slurry to promote the growth of the bacteria. Suitable nutrients for this purpose are nitrogen and phosphorous containing compounds such as ammonium sulfate and phosphate salts. The nitrogen and phosphorous nutrients are suitably maintained in a concentration range of between about $1\times10^{-3}$ and $6\times10^{-2}$ weight %. When carried out under the above conditions, the desulfurization process of the present invention results in the substantially complete removal of the pyrite from the coal. Moreover, this substantially complete removal of the pyrite from the coal can be attained at rates which are rapid enough to be practicable.

"*Thiobacillus ferrooxidans*" as the term is used herein and in the appended claims means an iron and sulfur oxidizing chemoautotrophic acidophilic, aerobic organism which can derive energy for its cellular functions by oxidizing inorganic chemical species containing iron or sulfur or both, such as pyrite, ferrous iron or elemental sulfur. The "*Thiobacillus ferrooxidans* group" as also used herein and in the appended claims is intended to include any organisms which meet the above definition of "*Thiobacillus ferrooxidans*" and in particular includes *Thiobacillus ferrooxidans, Thiobacillus thiooxidans* and *Ferrobacillus ferrooxidans.* The mechanism for the oxidation of pyrite in the presence of *Thiobacillus ferrooxidans* is believed to be represented by the following reactions:

$$FeS_2+14Fe^{+++}+8H_2O\rightarrow15Fe^{++}+2SO_4^{=}+16H^+ \quad (I)$$

$$Fe^{++}+H^++\tfrac{1}{4}O_2 \text{ bacteria } Fe^{+++}+\tfrac{1}{2}H_2O \quad (II)$$

The ferric ion thus produced can oxidize more pyrite as described by Equation I.

Equations I and II are summarized by Equation III.

$$2FeS_2+15/2O_2+H_2O_{bacteria}Fe_2(SO_4)_3+H_2SO_4 \quad (III)$$

The iron and sulfur oxidizing bacteria, e.g. *Thiobacillus ferrooxidans,* catalyze reaction (II) which would otherwise proceed at a very slow rate. As a result of the activity of the microorganisms, reaction (II) proceeds rapidly enough so that there is a sufficient concentration of $Fe^{+++}$ present at all times to allow the pyrite leaching reaction (I) to proceed at an acceptable rate. It can be seen that reaction (II) is essentially a means to regenerate $Fe^{+++}$ which is depleted by reaction (I). In addition, the iron and sulfur oxidizing organisms oxidize any reduced forms of sulfur, which may occur during the oxidation of the $S_2^{=}$ portion of the pyrite crystal, to water soluble sulfate.

DESCRIPTION OF THE PREFERRED EMBODIMENTS

Figure 1:
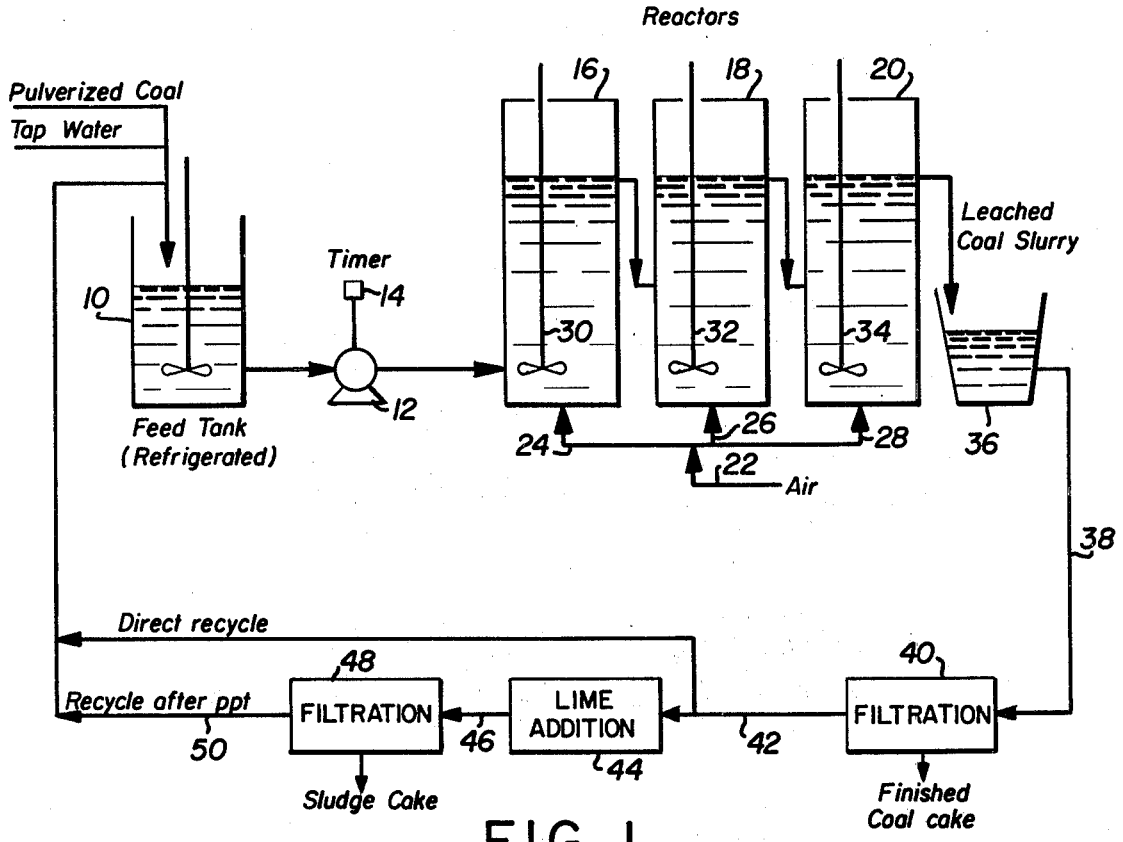
FIG. 1 is a schematic diagram illustrating a typical cyclic process for the desulfurization of coal in accordance with the present invention.

The process of the present invention is broadly applicable to the treatment of various types of coal. In particular, the process is directed to the desulfurization of bituminous coals which are combusted to generate steam in electric utility plants or industrial boilers. Examples of coals that may be treated in accordance with the present invention are the medium and high volatile bituminous coals from the following U.S. coal seams: Ohio No. 6, Ohio No. 8, Kentucky No. 9, Lower Freeport, Illinois No. 2, Illinois No. 6 and Lower Kittanning. It will be understood of course that the present invention is not limited to the treatment of the above mentioned coals alone and that coals other than bituminous coals such as anthracite and lignite coal may be treated as well with varying degrees of success. In general, the coals that are treated in accordance with the present invention will contain a pyritic sulfur concentration in the range of from about 0.5% to about 4% by weight of the coal.

In carrying out the process of the present invention, the raw coal which is obtained from mines in chunk size, for example, is first reduced to a particle size which will effectively expose a substantial fraction of the total surface of the pyrite that is contained in the coal. Generally speaking, the coal should be reduced to a particle size smaller than about 200 mesh.

The coal particles are then formed into a slurry with water in such a manner that the solids concentration in the slurry is between about 2.5 and 40% by weight. The slurry is then agitated and aerated and the pH is adjusted to an initial value of between about 1.5 and 6. The slurry may be agitated and aerated by bubbling air through the slurry. The air may be enriched with oxygen or alternatively it may be desirable to utilize pure oxygen instead of air. Additional mechanical means of agitation such as stirrors or turbines may also be used. In the preferred practice of the present invention, the oxygen concentration within the slurry should be maintained in the range of between about 4 ppm and 30 ppm. It may also be desirable to enrich the air with $CO_2$ in amounts ranging up to about 2% by volume of air or enriched air. The use of $CO_2$ serves to provide an additional source of carbon for the growth of microorganisms over and above that which naturally occurs in air. In particular, the $CO_2$ enrichment should be employed in the case where pure oxygen or air highly enriched with oxygen is used.

The maintenance of pH at a specific value within the range indicated above, i.e. about 1.5 to 6, during the course of leaching is a significant factor in carrying out the process of desulfurization at rates which are sufficiently rapid to be of practical interest. When the pH is maintained at a value either substantially below about 1.5 or above about 6, the rate of pyrite removal becomes undesirably slow. The reasons for this behavior is essentially two-fold: (1) at pH values outside of the above range, the activity of the microorganisms and the rate at which the bacteria oxidize reduced forms of iron diminishes appreciably, and (2) at pH values above about 3 the concentration of ferric ions in solution decreases rapidly with increasing pH. It has been found that in the preferred practice of the present invention the pH should be kept within the range of about 1.5 and 3.5, and even more preferably in some instances between about 1.7 and 2.3.

The pH may be adjusted to its initial value by the addition of mineral acid, preferably sulfuric acid, in the case where it is necessary to reduce the pH below the initial value of the coal slurry. Alternatively, the pH may be adjusted by the addition of a base such as sodium hydroxide or ammonia when it is necessary to increase the pH above the initial pH of the coal slurry. Sulfuric acid is generated during the leaching process as will be seen from the reaction mechanism in Equation III hereinabove. In order to maintain the pH in a range which is optimal for leaching it is necessary to neutralize the acid which is generated in the process. This may be accomplished by the periodic addition of base to the leaching slurry or alternatively, a portion of the slurry or slurry liquid can be treated with a base such as lime or limestone to precipitate sulfate and to neutralize acid. This treated slurry or slurry liquid can be recycled in the process to maintain a substantially constant pH in the leaching slurry. The latter method of pH control has the additional benefit of removing sulfate from the leaching medium and thereby minimizing the potential for the formation of undesirable sulfate precipitates.

After the pH has been adjusted to its initial value as described above, the slurry is inoculated with a culture of an iron and sulfur oxidizing bacteria selected from the *Thiobacillus ferrooxidans* group such as *Thiobacillus ferrooxidans.* Such organisms are of course well known in the art. They naturally inhabit acidic bodies of water such as may be found in the vicinity of sulfide ore deposits, ore tailings dumps and coal mines. The organisms can be grown or cultured by methods which are well known in the art, for example, on the medium 9K described by M. Silverman and D. Lundgren, Journal of Bacteriology Volume 77, page 642, 1959. Alternatively, it has been shown that the organisms can also be grown on media containing sulfur or natural pyrite as an oxidizable energy source.

As already indicated hereinabove, coal slurries have been inoculated in the past with concentrations of organisms in a range of about $2\times10^{12}$ to $2\times10^{13}$ cells/gram of pyrite present in the coal slurry, viz Silverman et al in their early work relative to the desulfurization of coal using microorganisms. It has been found, however, that the resting cell suspension described by Silverman et al do not effectively or completely leach pyritic sulfur from coal.

It has been unexpectedly discovered in accordance with the present invention that a growing or dynamic population of organisms is required for the continuing complete removal of the pyrite and that this dynamic cell population can be effectively obtained by providing an initial cell concentration of between about $3\times10^{10}$ and $1\times10^{12}$ cells/grams of pyrite present in the coal slurry. It is of course important for optimum results that this range of cell concentration be used together with the proper control of pH, temperature and oxygen concentration throughout the period of leaching. Depending upon the source of the coal, it may also be desirable to include a relatively small concentration of nitrogen and phosphorous containing material in the coal slurry to serve as supplemental nutrients for the microorganisms.

The microbiological leaching process of the present invention should be carried out within a temperature range of between about 10° and 35° C. and preferably within a temperature range between 15° and 33° C. It has been found that a maximum rate of leaching pyrite from coal occurs at a temperature of about 28° C. The rate of leaching falls off sharply at temperatures greater than about 30° C. Surprisingly, the temperature at which the optimum rate of leaching occurs, i.e. about 28° C., coincides with the temperature at which *Thiobacillus ferrooxidans* reproduce most rapidly rather than the temperature at which the same organisms oxidize iron in solution most rapidly (approximately 35° C.). This is further evidence to support the concept that a growing and dynamic cell population is required to achieve complete leaching of pyrite from coal.

The leaching process may be carried out in accordance with the present invention over many cycles in the growth of the microorganisms. It is beneficial and sometimes necessary in this case to add low concentration of nitrogen and phosphorous containing nutrients to the slurry. The nutrients may be nitrogen and phosphorous containing compounds such as ammonia, ammonium sulfate, urea, phosphoric acid or other inorganic phosphate salts. Generally, the nutrient should be added in amounts such that the concentration of nitrogen and phosphorous in the coal slurry is maintained in a range of from about $1\times10^{-3}$ to $6\times10^{-2}$ weight percent nitrogen and from about $5\times10^{-3}$ to $2\times10^{-2}$ weight percent phosphorous.

It has been found that the period of time that coal is maintained in contact with the active leaching medium in order to leach essentially all of the pyritic sulfur from the coal, i.e. the residence time, will vary depending upon the specific conditions under which the process of desulfurization is carried out. Generally, a residence time of between about 12 to 30 days will be required. At the conclusion of the leaching period, solid, desulfurized coal is recovered by separating the coal from the liquid phase of the slurry using well known techniques such as filtering or settling.

In order to carry out the process of the present invention in a continuing cyclic manner, the slurry is removed from the reaction vessel and fresh slurry is added at a rate which corresponds to a residence time equal to that given above. It will be understood that the slurry may be introduced to and removed from the reaction vessels in a discreet or a continuous manner and further that the leaching process may also be accomplished in stages. In the latter event, the slurry may be transferred from one stage to another in a discreet or continuous manner at a rate which provides for a total residence time as given above.

The coal slurry that is removed from the reaction vessel or from the final stage in a multi-stage process is separated into solid and liquid phases using well known techniques to recover the solid, desulfurized coal. If it is desired to recycle the slurry liquid, the liquid which results from this separation step is treated with a base, for example, lime or calcium carbonate, in order to neutralize the acid that is formed during the desulfurization process, and to precipitate sulfate. The resulting precipitate is then separated from the liquid which is recycled to the process along with an appropriate amount of make-up water. Proper control of pH in the leaching vessels may be accomplished by treating an appropriate fraction of the recycled liquid with base in the manner described above.

Alternatively, it may be desirable to treat the liquid portion of the slurry in the reaction vessel or vessels directly in order to properly control the pH of the leaching slurry. For example, a base such as NaOH or $NH_4OH$ can be added to the reaction vessel or vessels at a rate which controls the pH of the leaching slurry in the desired range described hereinabove. Otherwise, a fraction of the liquid portion of the slurry may be removed and treated in a manner similar to that described hereinabove. In this case, removal and treatment of slurry liquid should be carried out at a rate which maintains the pH of the slurry in the desired range as described hereinabove. In either of the above mentioned methods for pH control, the coal that is removed from the reaction vessel or from the final stage of a multistage process will be filtered or otherwise separated from the slurry liquid, and the recovered slurry liquid may be recycled to the process.

It may also be desirable in some instances to rinse the desulfurized coal product with water in order tc remove any soluble sulfate salts which may adhere to the coal. This wash water may also be recycled back to the process.

It has been found that in order to maintain rates of leaching which are rapid enough to be practical when the process is operated in a cyclic manner as described hereinabove, it is necessary to maintain the pH of the slurry within a narrow range of between about 1.5 and 2.8, and more preferably between 1.7 and 2.3. It is also desirable and in some cases necessary to add nitrogen and phosphorous containing nutrients to the slurry. Because acid is generated by the leaching process, it is not necessary to add acid to the slurry from an external source in order to establish an initial pH once the leaching operation has been initiated by methods of the invention.

It should be understood that there are a number of coals which when formed into an aqueous slurry will produce or generate certain water soluble organic materials such as formic acid, for example, that inhibit or destroy the activity of the iron and sulfur oxidizing organisms such as *Thiobacillus ferrooxidans.* When these coals are desulfurized in accordance with the processs of the present invention there will ordinarily occur an initial period where little or no desulfurization takes place, the initial period lasting anywhere from one to about four weeks depending on the particular coal. However, it has been found that this initial period of inactivity can be substantially eliminated in one of several different ways. First, the coal may be washed prior to desulfurization in order to remove the water soluble organic material from the coal. This prewash step however will not remove organic material which may be formed while the coal is in contact with the desulfurizing media. Furthermore, prewash entails undesirable expenses and generates undesirable pollution in the form of wash water which must be disposed of or treated so as to render it environmentally acceptable. Secondly, the water present in the coal slurry may be treated with activated carbon or other equivalent adsorbent to remove from the leaching medium any organic material which may be present and which may interfere with the activity of the microorganisms responsible for the solubilization of the pyrite in the coal. Such materials, for example, may be present in the coal prior to forming the slurry or may be produced by the interactions of water and oxygen with the organic fractions of the coal during the leach period. The concentrations of the organic material so formed is likely to be within the range of between about $1\times10^{-4}$ to $1\times10^{-2}$ molar and the quantity of activated carbon required to treat the aqueous leaching liquid can be readily determined by methods known in the art. The disadvantage of using activated carbon is mainly the additional cost. An alternative process for eliminating the inhibiting effect of these organic materials is to use mixed cultures of microorganisms containing heterotrophic organisms capable of removing or altering organic compounds such as acetic, formic or proprionic acids or rendering these compounds harmless. A process for desulfurization of coal using these mixed cultures is described and claimed in our copending application Ser. No. 903,256, filed on even date herewith and assigned to the common assignee hereof. Application Ser No. 903,256 is incorporated herein by reference and is made a part of this disclosure.

FIG. 1 schematically shows apparatus for carrying out a typical cyclic process in accordance with the present invention. As shown, ground coal (−200 mesh) is prepared as a slurry in tank 10. The slurry is fed by pump 12 which is controlled by timer 14 to the first reactor 16 in a series of three reactors 16, 18 and 20. Three reactors are shown for purposes of illustration although it will be understood that it is possible and in some cases desirable to employ a greater or smaller number of reactors. Furthermore, in the embodiment illustrated, the volume of all reactors is the same and accordingly the residence time of the coal slurry in each reactor is identical. Again, it may be desirable to vary the volume of each reactor and hence the residence time of the coal slurry in each stage of the leaching process. Air is supplied to each of the reactors 16, 18 and 20 via manifold 22 and inlets 24, 26 and 28. The coal slurries are maintained in suspension by means of mechanical agitator devices 30, 32 and 34. The residence time is determined by means of control timer 14 and pump 12. The coal slurry proceeds through reactor 16 to reactor 18 and then to reactor 20 as indicated by the arrows and is collected in vessel 36 where the slurry flows via conduit 38 to a mechanical filtration device 40. The filtration device used in this embodiment is a conventional vacuum filter of the type well known in the art. The product coal which is substantially depleted in pyritic sulfur is removed from the vacuum filter and then washed to remove residual sulfate sulfur outside of the filter device 40. Alternatively, the product coal can be washed with water prior to removal from the vacuum filter device 40. The filtrate from the filter 40 flows via conduit 42 to a vessel 44 in which it is reacted with lime or limestone in order to neutralize the acid that is produced during the desulfurization process and to precipitate sulfate which is also formed during the process. The neutralized filtrate flows via conduit 46 to filter device 49 which may be a conventional vacuum filter well known in the art. A solids cake consisting of gypsum and iron oxide is removed from the filter device 48 and the liquid filtrate is recycled via conduit 50 to tank 10 where it is used with additional make-up water to produce fresh slurry for the process. A portion of the filtrate from device 40 may by-pass tank 44, conduit 46 and filter device 48 to be recycled directly to tank 10 as may be desired for proper control of pH.

The process of the present invention can be carried out with a number of variations as will be evident to those skilled in the art. For example, it is not necessary to carry out the process in the exact order of steps described hereinabove. Thus, the pH of the slurry may be adjusted after inoculation of the slurry with the microorganisms. Moreover, it may not be necessary in some cases to actually inoculate the slurry when the coal that is being treated already contains a sufficient amount of the necessary microorganisms in the naturally occurring state. In this event, the present invention provides an optimum environment for the dynamic growth of the bacteria and for the leaching of pyrite from coal. Other variations in the process of the present invention should readily occur to those skilled in the art.

The following examples are illustrative of the practice of the present invention.

EXAMPLE I

Coal slurries containing 6% by weight of Illinois No. 2 coal were prepared in 500 ml. volumes in glass reactors. Air was bubbled through the slurries in order to aerate and agitate the slurries during the process. A typical analysis of Illinois No. 2 coal is given in Table I below.

TABLE I

Typical Analysis of Northwest Illinois No. 2 Coal

| | Percent Before Leaching |
|---|---|
| Pyritic Sulfur | 1.89% |
| Organic Sulfur | 1.10% |
| Sulfate Sulfur | 1.45% |
| Total Sulfur | 4.44% |
| Ash | 8.00% |
| Moisture | 5.07% |
| Carbon | 68.30% |
| Hydrogen | 4.50% |
| Oxygen | 19.53% |
| Volatile | 32.20% |
| BTU/lb | 11,670 |

When desired, 1.5 grams of ammonium sulfate were added to the slurries. The slurries were maintained at the desired temperature by immersion in a thermostated water bath and the pH of the slurry was adjusted to the desired initial value by the addition of sulfuric acid or sodium hydroxide. The slurries were then inoculated with an appropriate amount of a *Thiobacillus ferrooxidans* culture which had been grown and isolated by methods well known in the art. In order to monitor the rate of pyritic sulfur removal from the coal, samples of the slurry were periodically taken from the reactors and the coal in these samples was recovered and analyzed for sulfur content. The pH of the coal slurry was maintained at the desired value during the course of leaching by twice daily addition of either $H_2SO_4$ or NaOH.

Figure 2:
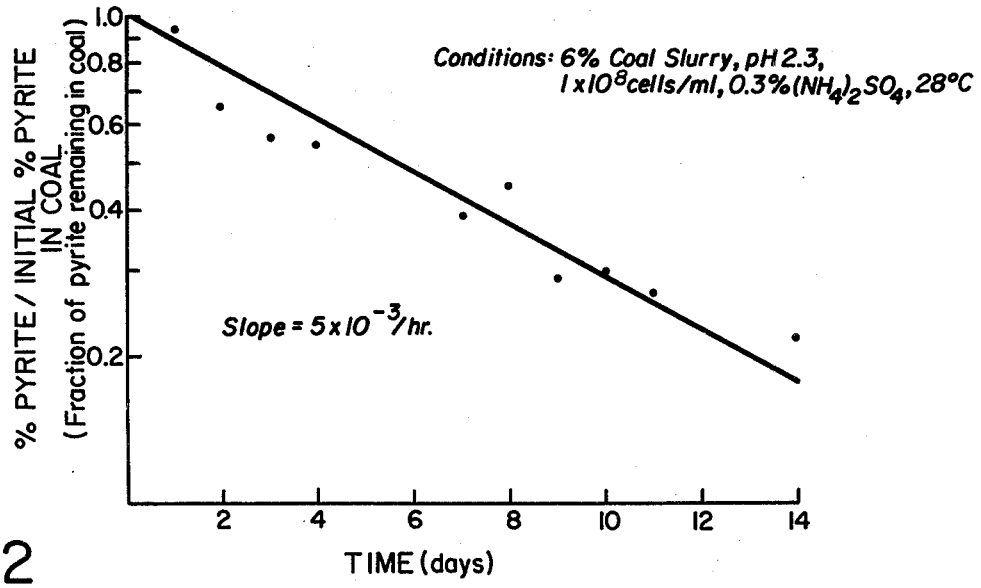
FIG. 2 is a graph showing a typical leaching rate that can be achieved with the desulfurization process of the present invention.

FIG. 2 is a representative log plot for the desulfurization process obtained at a pH of 2.3, a slurry temperature of 28° C. and with an initial cell concentration of $1\times10^8$ cells per ml., which corresponds to about $5\times10^{10}$ cells per gram of pyrite in the coal. It will be seen that in FIG. 2 the natural log of the fraction of pyrite remaining in the coal is plotted as a function of the leaching time and that a substantially linear relationship exists between these two variables. The slope of the curve shown in the figure is a first order rate constant for the desulfurization of coal carried out in accord with the process of the present invention. It will be further seen that the kinetics of desulfurization under the circumstances described herein closely follows a first order rate, that is, the rate of pyritic sulfur removal at any time is directly proportional to the amount of pyrite present in the slurry at that time, and the proportionality constant is the first order rate constant k.

Figure 3:
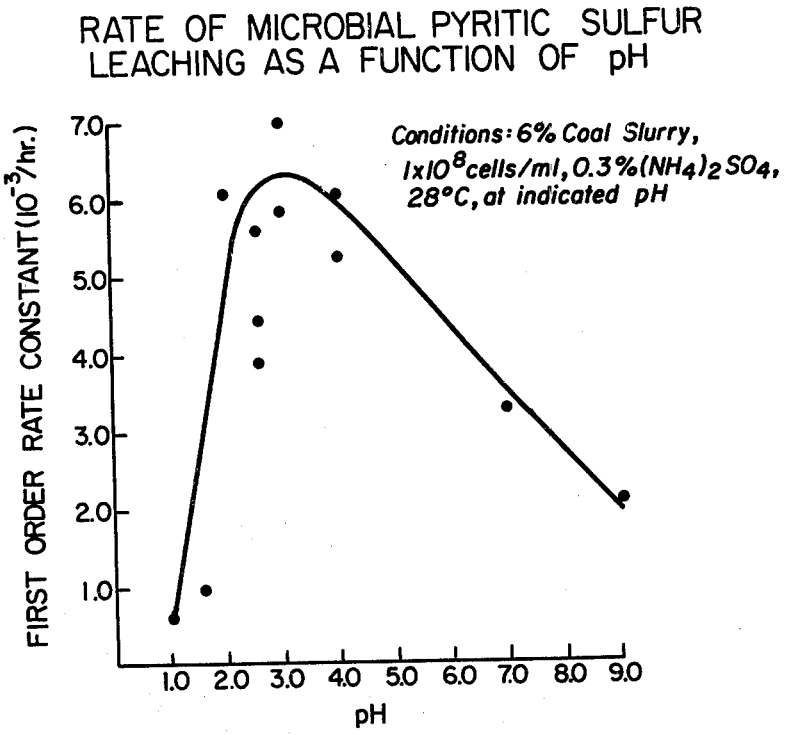
FIG. 3 is a graph showing the relationship between the leaching rate and pH of the slurry.

FIG. 3 shows the effect of varying the pH at which the microbiological desulfurization is carried out for a 6% coal slurry at 28° C. initially inoculated with $1\times10^8$ cells per ml., and 0.3 weight % ammonium sulfate added as a nutrient. It can be seen that there is a distinct maximum in the rate of leaching which occurs at pH range between 2 and 3 and that appreciable rates of leaching occur within the pH range of 1.5 and 6.

Figure 4:
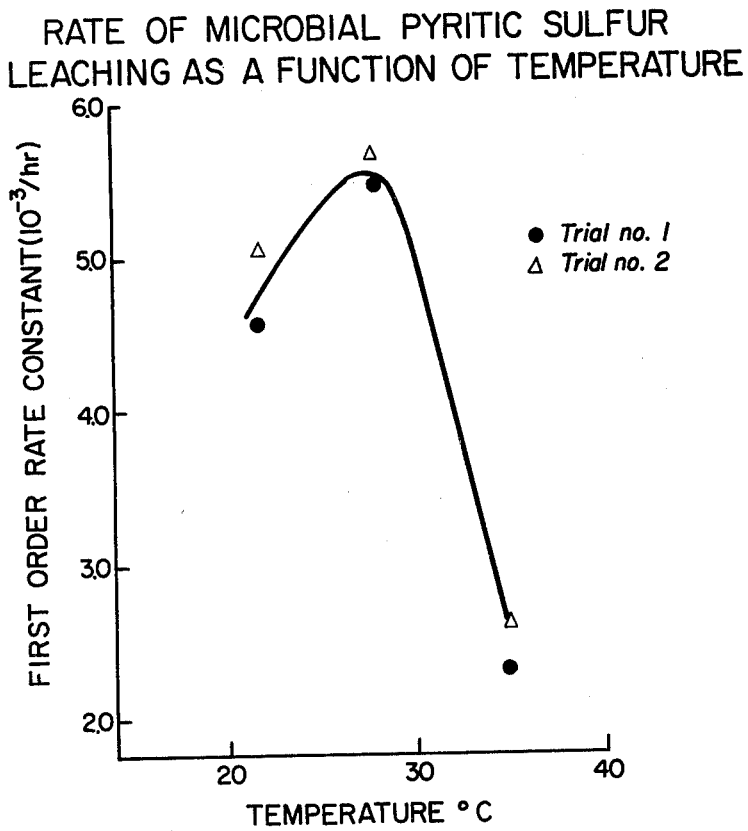
FIG. 4 is a graph showing the relationship between the leaching rate and the temperature of the slurry.

FIG. 4 represents the effects of temperature upon the rate of leaching at the optimum pH determined above. It can be seen that the rate of leaching increases with increasing temperature up to about 28° C. and falls off sharply with increasing temperatures above about 30° C.

The concentration of cells was varied in a 6% coal slurry in experiments carried out as described above from between about $5\times10^8$ cells per gram of pyrite and about $6\times10^{11}$ cells per gram of pyrite. The rate of leaching was measured and the first order rate constants were observed. The first order rate constants from these experiments are included in FIG. 5 in which they are shown as a function of the ratio of cells to pyrite concentration by the closed symbols. It will be seen that the rate increases rapidly as the ratio of cells to pyrite concentration increases above about $3\times10^{10}$ and then begins to level off at values of the ratio which are greater than about $1\times10^{12}$ cells per gram of pyrite.

EXAMPLE II

In order to determine the effectiveness of the present process of desulfurization as compared to the prior art, experiments were carried out using the conditions and methods described by Silverman et al. supra. Flasks were prepared containing 300 milligrams of coal, an inoculum of *Thiobacillus ferrooxidans,* and sufficient water acidified with $H_2SO_4$ to make up a slurry volume of 12 ml. The flasks were placed in a room temperature shaker bath and agitated with a frequency of 110 Hertz. In each experiment, a series of flasks was inoculated at the same time and an uninoculated control flask was set up for each inoculated flask. As the experiments progressed, sample inoculated flasks and control flasks were taken from the bath, the coal was removed from the slurry and the sulfur content of the coal was measured after rinsing with 10% HCl and water. The coal that was used in these experiments was Illinois No. 2 coal. An analysis of the particular sample of Illinois No. 2 coal used in the experiments is given in Table II.

TABLE II

| Typical Analysis of Northwest Illinois No. 2 Coal | |
|---|---|
| % Total Sulfur | 3.9 |
| Pyritic Sulfur | 1.2 |
| Organic Sulfur | 1.1 |
| Sulfate Sulfur | 1.6 |
| Ash | 7 |

Figure 5:
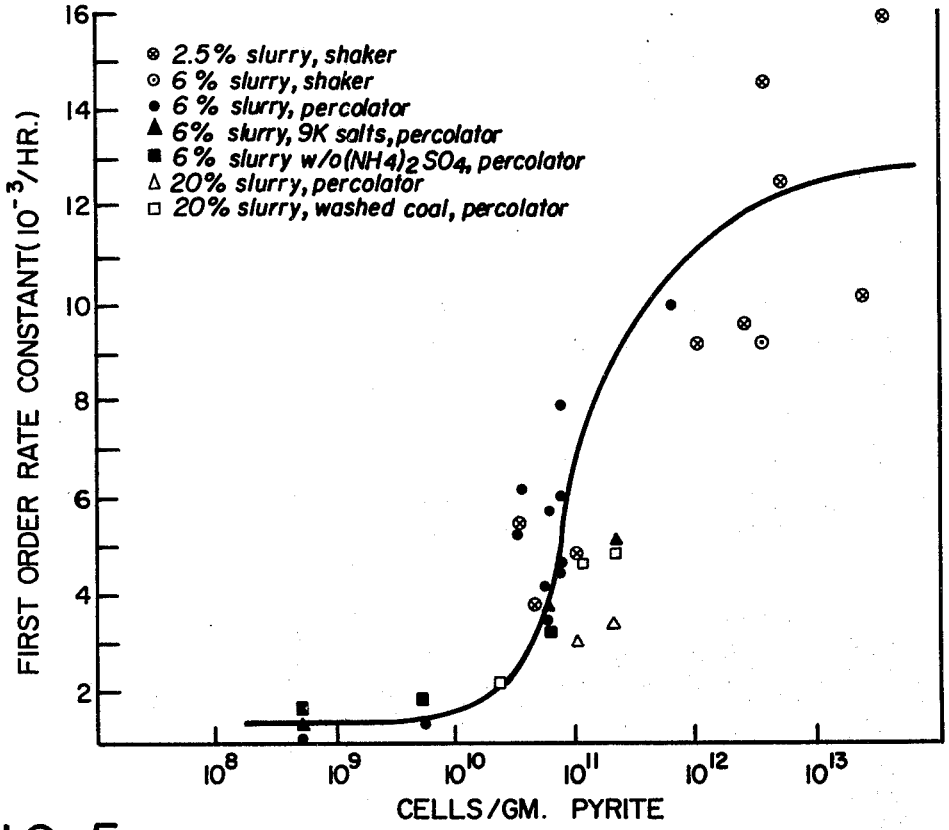
FIG. 5 is a graph showing the relationship between the leaching rate and the bacteria cell concentration in the slurry expressed as the ratio of number of cells to grams of pyrite present in the slurry.
Figure 6:
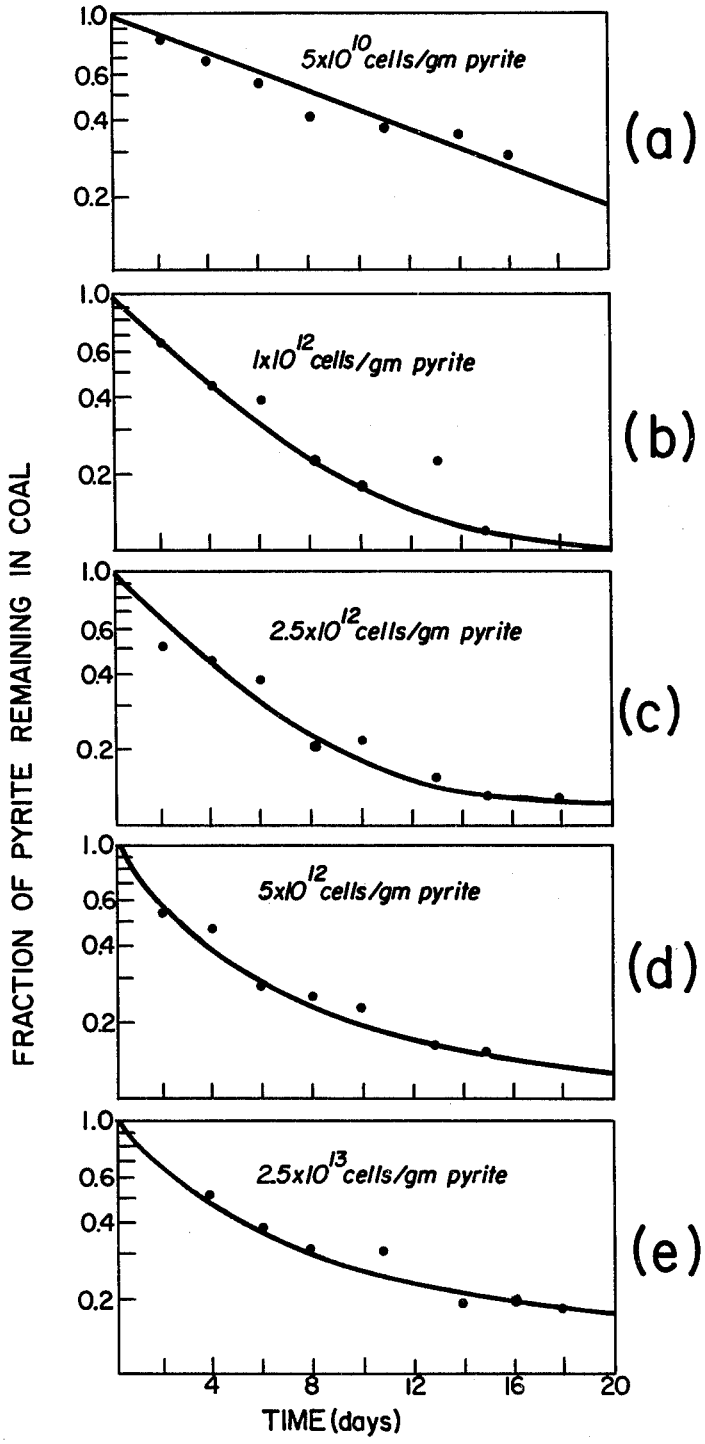
FIGS. 6*a–e* are graphs showing the leaching rate at different cell concentrations.

Experiments were performed at a range of cell concentrations to determine the effects of the ratio of cell to pyrite concentration in the leaching process. Although the work of Silverman et al were conducted at initial pH values of 2.6 and 3.5, it was chosen to carry out these experiments at a pH value of 2.3 in order to minimize the possibility that iron containing precipitates would form on the coal slurry during the experiments. It is to be further noted, that the experiments of Silverman et al were conducted without any control over the pH during the course of leaching and that, therefore, the actual value of the pH during leaching could not be determined and would be influenced by the properties of the ash components in a particular coal. Results of the above experiments are shown in FIGS. 5 and 6. In FIG. 5, the first order rate constants which characterize the initial stage of pyrite leaching for this set of experiments are shown by the "X" marked circles. It can be seen that these results are consistent with the observation in Example I that the rate constant which characterizes leaching tends to a constant value at high ratios of cells per gram of pyrite, in particular greater than about $1\times10^{12}$. The results from other experiments are indicated by the solid squares and the open and solid triangles, etc. which further support the above example. Furthermore, FIG. 6 indicates that at these high values of cell concentration, which are characteristic of the prior art, the rate of leaching diminishes with time, and that as a result the leaching is no longer described by a first order rate constant over its entire range. In fact, it can be seen from FIG. 6 that for leaching times greater than about 14 days the rate of leaching drops significantly below that which occurs when an initial cell to pyrite ratio of $5\times10^{10}$ cells per gram of pyrite is used. It is postulated that the decrease in the rate of leaching is associated with a decrease in the activity of the microorganisms and perhaps even with the death of a significant fraction of the organisms present in the coal slurry.

Table III shows evidence for the postulated death of a significant number of organisms under the conditions utilized by Silverman.

TABLE III

| Cell Viability Measurements | | |
|---|---|---|
| Slurry concentration | | 2.5% |
| pH | | 2.3 |
| Cell concentration | | $3\times10^9$ cells/ml ($4\times10^{12}$ cells/gm pyrite) |
| Coal | | Illinois No. 2, −200 mesh |
| Rate constant for iron oxidizing ability of cells removed from slurry on day: | 1 | 0.66/hr |
| | 3 | 0.66/hr |
| | 4 | 0.66/hr |
| | 7 | 0.24/hr |
| | 8 | 0.24/hr |

In this table the rate constant which characterizes the rate at which a fixed volume of solution recovered from a leaching experiment carried out with $4\times10^{12}$ cells per gram of pyrite initial inoculum oxidizes ferrous iron in solution is given as a function of time during a leaching experiment. This number is proportional to the concentration of living cells present in the slurry, and it can be seen that by the seventh day this number decreased to only 36 percent of its initial value. It is postulated further that with additional time this number will decrease even further to a point where desulfurization would no longer occur at an appreciable rate. Because of this, the conditions that are suggested by the prior art, notably Silverman et al, are not appropriate for a viable commercial process in which leaching must be carried out over an indefinite number of cycles without the repeated addition of fresh inoculum of microorganisms from an external source. It should also be noted that for a process to be economically attractive slurry concentrations of approximately 20% are required, and under these conditions it would not be possible to grow and maintain the concentration of the cells that are suggested by the prior art in an economically feasible way.

EXAMPLE III

The following experiment was conducted to demonstrate the beneficial effect of washing certain coals prior to carrying out the microbial desulfurization process. 20% slurries of West Virginia Redstone coal and of West Virginia Sewickley coal of analysis given in Table IV below were prepared.

TABLE IV

Effect of Prewashing on Rate of Pyrite Removal

| Coal | % Total S | % Pyrite S | % Organic S | % Sulfate S | % Ash | First order rate constants for pyrite removal: Unwashed Coal | First order rate constants for pyrite removal: Washed Coal |
|---|---|---|---|---|---|---|---|
| W. Va. Redstone | 2.4 | 0.8 | 1.3 | 0.2 | 9.0 | $0.8\times10^{-3}$/hr | $3.0\times10^{-3}$/hr |
| W. Va. Sewickley | 5.0 | 2.3 | 1.8 | 0.9 | 20 | $0.25\times10^{-3}$/hr | $3.1\times10^{-3}$/hr |

The coals were ground to −200 mesh, and in one case were washed with water prior to microbiological leaching and in a second case were not washed at all prior to leaching. Experiments were carried out at a pH of 2.3, an initial cell concentration of $5\times10^8$ cells per ml. and at 23° C. The first order rate constants observed are given in Table IV, and it can be seen the rate of leaching increased by greater than fourfold when the coal was washed prior to the actual leaching operation. It should be noted that the improvement in the rate of leaching described above which is brought about by prewashing the coal with water is limited to only certain coals. In general these coals are desulfurized relatively more slowly than other coals, but pre-washing improves the rate of leaching to a value which is typically characteristic of the majority of coals which have been subjected to the process of the present invention. It is postulated that the improvement which is brought about by prewashing in the case of certain specific coals is due to the removal during the washing step of material which is present on the coal and which if not removed would interfere with the effectiveness of the microbiological leaching process. This effect will vary from coal to coal and be more severe in some cases than in others as is evidenced by the data in Table IV.

EXAMPLE IV

The following example illustrates a typical cyclic process for the desulfurization of coal in accordance with the present invention. Apparatus as shown in FIG. I was used for carrying out this cyclic process. The ground coal (−200 mesh) was prepared as a slurry in tank 10. The slurry was fed by pump 12 to the first reactor 16. The volume of the reactors 16, 18 and 20 was the same, and accordingly the residence time for the coal slurry in each reactor was identical. Air was supplied to each of the reactors 16, 18 and 20 as described above. In this example, residence times of 26.9 and 20.5 days were used. The product coal, which was substantially depleted in pyritic sulfur, was collected at the filtration device 40. The coal was then washed to remove residual sulfate sulfur. A portion of the filtrate from the filter 40 was passed via conduit 42 to vessel 44 where it was reacted with lime or limestone to neutralize the acid produced during the desulfurization process and to precipitate sulfate which was also formed during the process. The neutralized filtrate was passed onto filter device 48 and a solids cake consisting of gypsum and iron oxide was removed. The liquid filtrate was then conducted via conduit 50 to tank 10 where it was combined with the portion of filtrate which had bypassed vessel 44 and filter 48 and was used with additional make-up water to produce fresh slurry for the process. In this example, the pH of the feed slurry was maintained at pH 2.0 and the pH of the product coal slurry in tank 36 was 1.9. In addition, ammonium sulfate and phosphoric acid were added with each batch of fresh coal slurry in amounts of 200 mg. ammonium sulfate and 425 mg. of phosphoric acid per liter of the coal slurry. Supplemental quantities of caustic soda were added as required to vessel 16 in order to control pH. The leaching was carried out at ambient temperatures which varied from 15° C. to 21° C.

Figure 7:
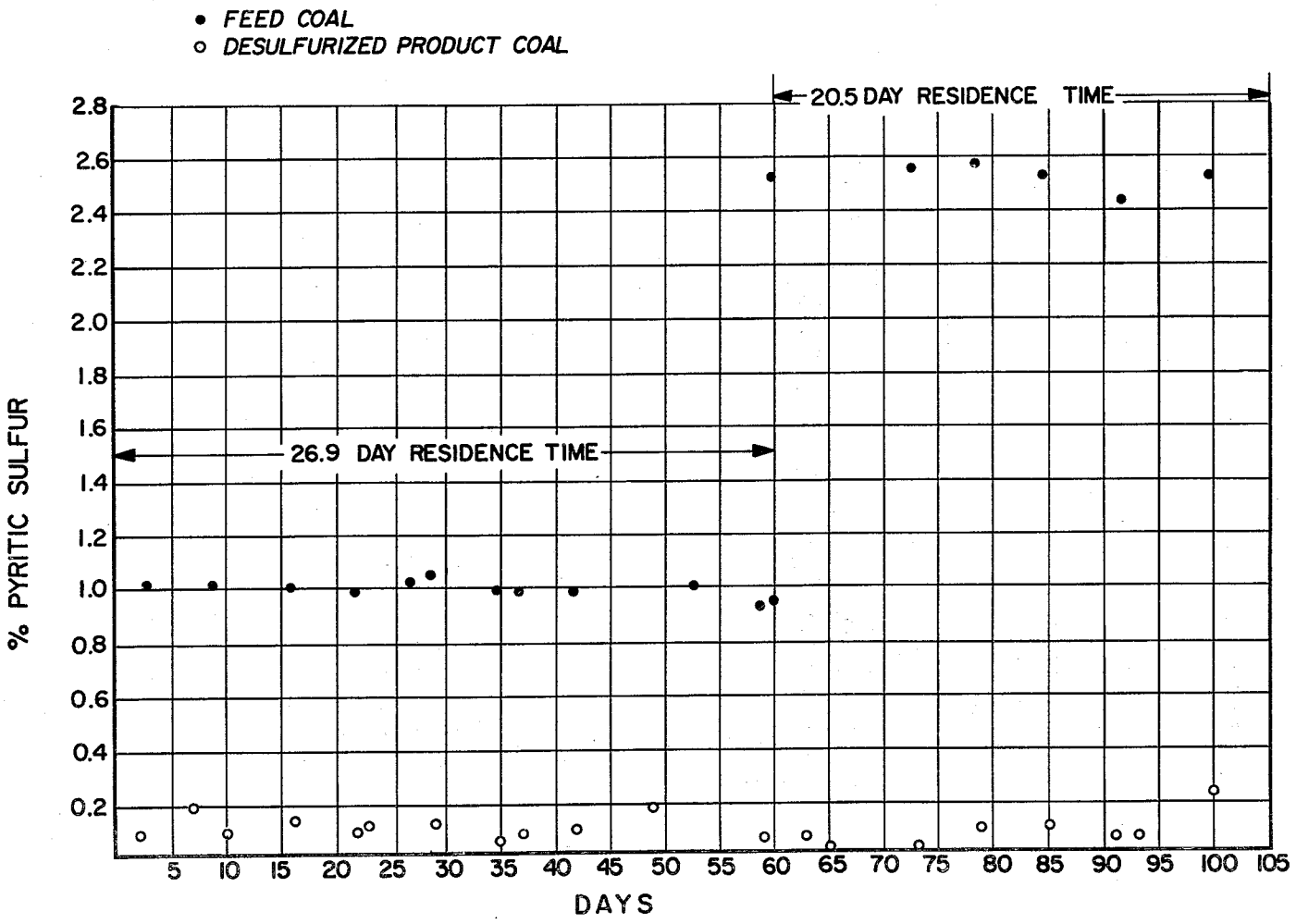
FIG. 7 is a graph showing the results of desulfurization obtained from a cyclic leaching process in accordance with the present invention.

The results of coal desulfurization performed under the conditions of this example are shown in FIG. 7. The data points plotted in this figure show the pyritic sulfur content of the feed coal and product coal after the process described hereinabove had achieved a steady state of operation. Furthermore, the pyritic sulfur content of the feed coal and product coal is shown for a prolonged period of leaching without any addition of microorganisms subsequent to the initial inoculation which produced a cell concentration of approximately $5\times10^8$ cells/ml in vessel 16. It will be seen from the figure that a coal containing approximately 1% pyritic sulfur was desulfurized in an average residence time of 26.9 days so that approximately 90% of the pyritic sulfur was removed from the coal. In addition, a coal containing approximately 2.7% pyritic sulfur was desulfurized using an average residence time of 20.5 days such that greater than 95% of the pyritic sulfur was removed from the coal.

EXAMPLE V

Figure 8:
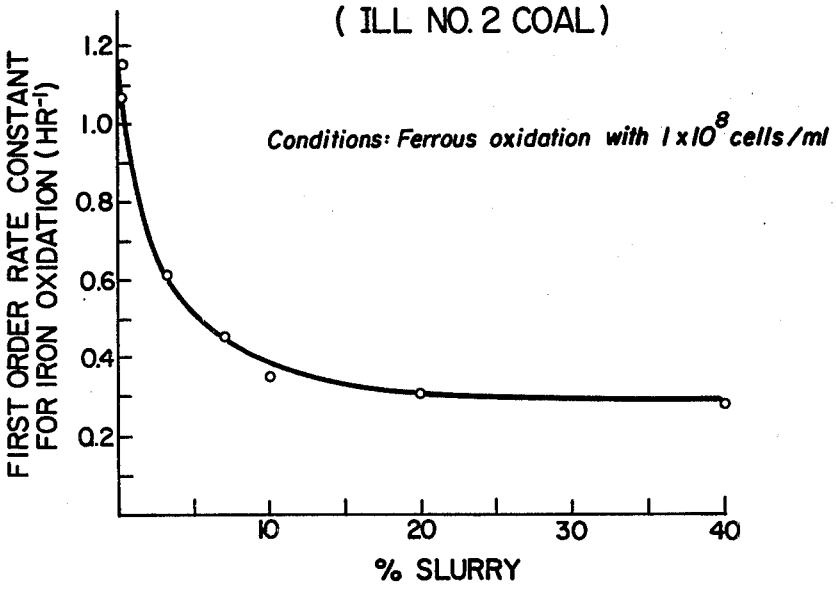
FIG. 8 is a graph showing the inhibitory effect which exposure to certain coal derived material exerts on the iron oxidizing ability of *Thiobacillus ferrooxidans.*

In order to demonstrate the effectiveness of the use of activated carbon or other adsorbent to treat the coal slurry liquid, the following experiment was conducted. Illinois No. 2 coal was ground to minus 200 mesh and slurries ranging in concentration from about 3% to 40% by weight were prepared. The water from each of these slurries was recovered after 90 minutes of contact with the coal. The water was treated with lime, filtered and the pH adjusted to 2.3 with sulfuric acid. Iron in the form of soluble ferrous sulfate was then added to each sample of water removed from the coal slurries to give a final ferrous concentration of 600 ppm. 110 millimeters of this solution were added to a 200 ml. flask followed by the addition of $10^{10}$ cells of *Thiobacillus ferrooxidans.* The flask was then agitated and the rate of oxidation of ferrous to ferric was measured. The results of these experiments are shown in FIG. 8. It will be seen that there is a substantial inhibition of the activity of *Thiobacillus ferrooxidans* associated with the presence of water which had been exposed to the coal and that this inhibition increases with the concentration of coal to which the water had been exposed in the initial slurries. For example, water obtained from a 3% coal slurry decreases the activity of *Thiobacillus ferrooxidans* by approximately 45%, whereas water removed from a 20% slurry decreases the activity of *Thiobacillus ferrooxidans* by approximately 73%. It has been found that this inhibition can be completely overcome by treatment of the water with activated carbon prior to the addition of the *Thiobacillus ferrooxidans* and iron sulfate. For example, when 100 ml. of otherwise inhibiting wash water obtained as described hereinabove was treated with one gram of activated carbon (Calgon filtrasorb 300), inhibition of iron oxidation was not observed.

What is claimed is:

1. A process for the removal of pyrite from coal which comprises the steps of:

preparing an aqueous slurry containing finely-divided coal particles of a size sufficient to expose a substantial fraction of the total surface of the pyrite in the coal;

maintaining the pH of the slurry at a value between about 1.5 and 6;

maintaining the slurry at a temperature of between about 10° and 35° C.;

providing an oxygen or oxygen-containing atmosphere in contact with the slurry; and subjecting the slurry to the action of iron and sulfur oxidizing microorganisms selected from the *Thiobacillus ferrooxidans* group while agitating the slurry for a period of time sufficient to oxidize and solubilize substantially all of the pyrite in the coal, the initial concentration of the microorganisms being in a range of between about $3\times10^{10}$ and $1\times10^{12}$ cells per gram of pyrite present in the coal slurry.

2. The process as defined by claim 1 wherein the slurry contains between about 2.5 and 40% by weight coal.

3. The process as defined in claim 1 wherein the finely-divided coal particles are of a size no larger than about 200 mesh.

4. The process as defined by claim 1 wherein the pH of the slurry is maintained at a value between about 1.5 and 3.5.

5. The process as defined by claim 1 wherein the pH of the slurry is periodically adjusted by the addition of a base to neutralize the acid generated during the leaching process.

6. The process as defined by claim 1 wherein a portion of the aqueous slurry or slurry liquid is treated with a base to neutralize the acid generated during the leaching process and is then recycled to maintain a substantially constant pH in the slurry.

7. The process as defined by claim 1 wherein the slurry is maintained at a temperature of between about 15° and 33° C.

8. The process as defined by claim 1 wherein the oxygen concentration within the slurry is maintained between about 4 and 30 parts per million in solution.

9. The process as defined by claim 1 wherein the slurry is agitated by bubbling air, oxygen or oxygen-enriched air through the slurry.

10. The process as defined by claim 1 wherein the oxygen or oxygen-containing atmosphere is enriched with carbon dioxide.

11. The process as defined by claim 10 wherein the concentration of carbon dioxide is in a range of up to about 2% by volume of the oxygen or oxygen-containing atmosphere.

12. The process as defined by claim 1 wherein nutrients are added to the slurry for growth of the microorganisms.

13. The process as defined by claim 12 wherein the nutrients consist of nitrogen and phosphorous-containing compounds.

14. The process as defined by claim 13 wherein the concentration of the nitrogen and phosphorous-containing compounds is maintained in the range of from about $1\times10^{-3}$ to $6\times10^{-2}$ weight percent nitrogen and from about $5\times10^{-3}$ to $2\times10^{-2}$ weight percent phosphorous.

15. The process as deinfed by claim 1 wherein the slurry is filtered to separate the solid coal after removal of the pyrite from the coal.

16. The process as defined by claim 1 wherein the finely-divided coal particles are rinsed with water prior to preparation of the coal slurry.

17. The process as defined by claim 1 wherein the slurry liquid containing the finely-divided coal particles is treated with activated carbon to remove inhibitory organic compounds.

18. A process for the removal of pyrite from coal which comprises the steps of:

preparing an aqueous slurry containing finely-divided coal particles of a size no larger than about 200 mesh;

maintaining the pH of the slurry at a value between about 1.5 and 3.5;

maintaining the slurry at a temperature of between about 15° and 33° C.;

bubbling air, oxygen or oxygen-enriched air through the slurry;

subjecting the slurry to the action of *Thiobacillus ferrooxidans* for a period of time sufficient to oxidize and solubilize substantially all of the pyrite in the coal, the initial concentration of the *Thiobacillus ferrooxidans* being in the range of between about $3\times10^{10}$ and $1\times10^{12}$ cells per gram of pyrite present in the slurry; and separating the slurry into a liquid and solid phase to recover the desulfurized solid coal.

19. The process as defined by claim 18 wherein the pH of the slurry is maintained at a value between about 1.5 and 2.8.

20. The process as defined by claim 18 wherein the pH of the slurry is maintained at a value between about 1.7 and 2.3.

21. The process as defined by claim 18 wherein the pH of the slurry is periodically adjusted by the addition of a base to neutralize the acid generated during the leaching process.

22. The process as defined by claim 18 wherein a portion of the aqueous slurry or slurry liquid is treated with a base to neutralize the acid generated during the leaching process and is then recycled to maintain a substantially constant pH in the slurry.

23. The process as defined by claim 18 wherein the slurry is maintained at a temperature of about 28° C.

24. The process as defined by claim 18 wherein the oxygen concentration within the slurry is maintained between about 4 and 30 parts per million in solution.

25. The process as defined by claim 18 wherein the air, oxygen or oxygen enriched air contains carbon dioxide.

26. The process as defined by claim 25 wherein the concentration of carbon dioxide is in a range of up to about 2% by volume of the air, oxygen or oxygen enriched air.

27. The process as defined by claim 18 wherein nitrogen and phosphorous-containing compounds are added to the slurry as nutrients to promote the growth of the microorganisms.

28. The process as defined by claim 27 wherein the concentration of the nitrogen and phosphorous-containing compounds is maintained in the range of from about $1\times10^{-3}$ to $6\times10^{-2}$ weight percent nitrogen and from about $5\times10^{-3}$ to $2\times10^{-2}$ weight percent phosphorous.

29. The process as defined by claim 18 wherein the slurry is filtered to separate the solid coal after removal of the pyrite from the coal.

30. The process as defined by claim 18 wherein the finely-divided coal particles are rinsed with water prior to preparation of the coal slurry.

31. The process as defined by claim 18 wherein the slurry liquid containing the finely-divided coal particles is treated with activated carbon to remove inhibitory organic compounds.

32. A cyclic process for the removal of pyrite from coal which comprises:

(a) forming an aqueous coal slurry by contacting together finely-divided coal particles and water;

(b) maintaining the pH of the slurry at a value between about 1.5 and 3.5;

(c) maintaining the slurry at a temperature of between about 10° and 35° C.;

(d) providing an oxygen or oxygen-containing atmosphere in contact with the slurry;

(e) subjecting the slurry to the leaching action of iron and sulfur oxidizing microorganisms selected from the *Thiobacillus ferrooxidans* group while agitating the slurry for a period of time sufficient to oxidize and solubilize substantially all of the pyrite in the coal, the initial concentration of the microorganisms being in a range of between about $3\times10^{10}$ and $1\times10^{12}$ cells per gram of pyrite present in the slurry;

(f) separating the slurry into a liquid and solid phase to remove the desulfurized solid coal;

(g) treating the liquid phase so as to neutralize acid generated during desulfurization;

(h) removing precipitates from the liquid phase;

(i) passing the liquid phase into contact with additional water and finely-divided coal particles to form fresh slurry; and (j) treating the fresh slurry by repeating steps (b) to (i).

33. The cyclic process as defined by claim 32 wherein the finely-divided coal particles are of a size no larger than about 200 mesh.

34. The cyclic process as defined by claim 32 wherein the pH of the slurry is maintained at a value between about 1.5 and 2.8.

35. The cyclic process as defined by claim 32 wherein the pH of the slurry is maintained at a value between about 1.7 and 2.3.

36. The cyclic process as defined by claim 32 wherein the slurry is maintained at a temperature of between about 15° and 33° C.

37. The cyclic process as defined by claim 32 wherein the oxygen concentration within the slurry is maintained between about 4 and 30 parts per million in solution.

38. The cyclic process as defined by claim 32 wherein the slurry is agitated by bubbling air, oxygen or oxygen-enriched air through the slurry.

39. The cyclic process as defined by claim 32 wherein the oxygen or oxygen-containing atmosphere is enriched with carbon dioxide.

40. The cyclic process as defined by claim 39 wherein the concentration of carbon dioxide is in a range of up to about 2% by volume of the oxygen or oxygen-containing atmosphere.

41. The cyclic process as defined by claim 32 wherein nitrogen and phosphorous-containing compounds are added to the slurry as nutrients to promote the growth of the microorganisms.

42. The cyclic process as defined by claim 41 wherein the concentration of the nitrogen and phosphorous-containing compounds is maintained in the range of from about $1\times10^{-3}$ to $6\times10^{-2}$ weight percent nitrogen and from about $5\times10^{-3}$ to $2\times10^{-2}$ weight percent phosphorous.

43. The cyclic process as defined by claim 32 wherein the liquid phase is treated with lime or limestone in order to neutralize the acid that is produced during the process and to precipitate sulfate.

44. The cyclic process as defined by claim 32 wherein a portion of the separated liquid phase is passed into contact with additional water and finely-divided coal particles to form the fresh slurry without neutralizing acid or removing precipitates from said portion of the liquid phase.

45. The cyclic process as defined by claim 32 wherein the finely-divided coal particles are rinsed with water prior to preparation of the coal slurry.

46. The cyclic process as defined by claim 32 wherein the slurry liquid containing the finely-divided coal particles is treated with activated carbon to remove inhibitory organic compounds.

47. The cyclic process as defined by claim 32 wherein coal slurry is treated in a continuous manner following steps (b) to (j) inclusive.

48. The cyclic process as defined by claim 33 wherein coal slurry is treated in a discreet manner following steps (b) to (j) inclusive.

* * * * *